US009445674B2

(12) United States Patent
Jones et al.

(10) Patent No.: US 9,445,674 B2
(45) Date of Patent: Sep. 20, 2016

(54) GRAVITY FED SHELVING DISPLAY SYSTEM

(71) Applicant: Kimberly-Clark Worldwide, Inc., Neenah, WI (US)

(72) Inventors: Mary Patricia Jones, Villa Park, IL (US); Dennis Patrick Rockhill, Green Bay, WI (US); Robert James Wurm, De Pere, WI (US); Sarah Lee Christoffel, Appleton, WI (US); Rebecca Rae Ann Joski, Kewaunee, WI (US); Brenda Faye Tennessen, Appleton, WI (US); Allexander Joseph Shorey, Little Suamico, WI (US); Robert Paul Vigneau, Highland Park, IL (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 14/766,070

(22) PCT Filed: Aug. 14, 2014

(86) PCT No.: PCT/US2014/051104

§ 371 (c)(1),
(2) Date: Aug. 5, 2015

(87) PCT Pub. No.: WO2016/024979

PCT Pub. Date: Feb. 18, 2016

(65) Prior Publication Data

US 2016/0135613 A1 May 19, 2016

(51) Int. Cl.

| | |
|---|---|
| ***A47F 1/12*** | (2006.01) |
| ***A47F 5/00*** | (2006.01) |

(Continued)

(52) U.S. Cl.
CPC . *A47F 1/12* (2013.01); *A47F 1/08* (2013.01); *A47F 5/00* (2013.01); *A47F 7/005* (2013.01); *A47K 10/185* (2013.01); *A47K 10/22* (2013.01)

(58) Field of Classification Search
CPC ..... A47F 1/12; A47F 1/08; A47F 7/005; A47F 5/00; A47K 10/22; A47K 10/185; G09F 1/10; G09F 3/20; G09F 3/201
USPC ..... 211/85.5
See application file for complete search history.

(56) References Cited

U.S. PATENT DOCUMENTS 1,693,231 A * 11/1928 Gruber ..... A47F 1/08 312/42
3,194,620 A * 7/1965 Sauer ..... A47F 1/08 211/59.2

(Continued)

FOREIGN PATENT DOCUMENTS

JP 2002-153360 A 5/2002

*Primary Examiner* — Korie H Chan
(74) *Attorney, Agent, or Firm* — Kimberly-Clark Worldwide, Inc.

(57) ABSTRACT

The present disclosure provides a shelving display system comprising substantially horizontal shelves, multi-chute gravity feed units and advertising panels. The horizontal shelves may be arranged in any number of configurations to display and dispense consumer goods. In a particularly preferred embodiment a horizontal shelf defines the lower portion of the shelving display system. Generally the horizontal shelves are spaced and arranged so as to display and dispense products, such as bundled consumer goods, and more preferably bundles of paper towels, facial and bath tissue.

12 Claims, 10 Drawing Sheets

(51) Int. Cl.

| | |
|---|---|
| ***A47F 1/08*** | (2006.01) |
| ***A47F 7/00*** | (2006.01) |
| ***A47K 10/18*** | (2006.01) |
| ***A47K 10/22*** | (2006.01) |

(56) References Cited

U.S. PATENT DOCUMENTS

| | | | | |
|---|---|---|---|---|
| 3,404,927 | A * | 10/1968 | Mellion | A47F 1/08 211/59.2 |
| 3,574,528 | A * | 4/1971 | Mellion | A61L 2/00 312/31 |
| 3,805,964 | A | 4/1974 | Titus | |
| 3,879,095 | A | 4/1975 | Seamans et al. | |
| 4,744,489 | A | 5/1988 | Binder et al. | |
| 4,798,013 | A * | 1/1989 | Sainato | G09F 1/10 211/102 |
| 6,918,499 | B2 | 7/2005 | De Land et al. | |
| 6,991,116 | B2 | 1/2006 | Johnson et al. | |
| 7,257,544 | B2 | 8/2007 | Rose et al. | |
| 7,665,618 | B2 * | 2/2010 | Jay | A47F 1/12 211/59.2 |
| 7,734,495 | B2 | 6/2010 | Klaubauf et al. | |
| 7,885,865 | B2 | 2/2011 | Benson et al. | |
| 7,909,296 | B2 * | 3/2011 | Moran-Grover | A47F 5/0846 211/103 |
| 2003/0000899 | A1 | 1/2003 | Barrett et al. | |
| 2003/0014291 | A1 | 1/2003 | Kane et al. | |
| 2005/0279579 | A1 | 12/2005 | Milk et al. | |
| 2006/0271427 | A1 | 11/2006 | Raimondo | |
| 2006/0278591 | A1 | 12/2006 | Tippets et al. | |
| 2007/0050235 | A1 | 3/2007 | Ouimet | |
| 2007/0288296 | A1 | 12/2007 | Lewis | |
| 2008/0202954 | A1 | 8/2008 | Knobloch et al. | |
| 2008/0202965 | A1 | 8/2008 | Duval et al. | |
| 2008/0245491 | A1 | 10/2008 | Knobloch et al. | |
| 2009/0056435 | A1 | 3/2009 | Duval et al. | |
| 2009/0057171 | A1 | 3/2009 | Roetker et al. | |
| 2009/0159546 | A1 * | 6/2009 | Squitieri | A47F 1/12 211/153 |
| 2009/0266776 | A1 | 10/2009 | Johnson | |
| 2010/0217681 | A1 | 8/2010 | Geikie et al. | |
| 2011/0114579 | A1 | 5/2011 | Breeden et al. | |
| 2011/0276364 | A1 | 11/2011 | Bergstrom et al. | |
| 2013/0192106 | A1 | 8/2013 | Meyer-Hanover et al. | |
| 2014/0217046 | A1 * | 8/2014 | Wang | A47B 96/028 211/134 |

* cited by examiner

GRAVITY FED SHELVING DISPLAY SYSTEM

RELATED APPLICATIONS

The present application is a national-phase entry, under 35 U.S.C. §371, of PCT Patent Application No. PCT/US14/51104, filed on Aug. 14, 2014, which is incorporated herein by reference in a manner consistent with the instant application.

TECHNICAL FIELD

The present invention relates to a shelving display system and more particularly a system for display and dispensing consumer products which may be display and dispensed in both individually packaged and multi-packaged forms.

BACKGROUND OF THE DISCLOSURE

Conventional prior art gondola generally consist of a base extending from a pair of generally vertical base posts. Upright base posts are attached to the gondola by conventional attachment means. Such conventional attachment means include pre-formed apertures in the base for receiving the distal ends of the posts. In this arrangement, means are provided for locking the posts in place using, for example, a locking bolt or sliding tab mounted in the base that engages the post surface. Alternatively, the posts may be bolted to outside vertical surfaces of the base. The posts typically have apertures on their front and rear surfaces, and shelf brackets and shelves would be mounted to the apertures on the front and rear surfaces of the posts.

While conventional gondolas are highly functional and widely used, they do have certain shortcomings. For example, only one horizontal shelf can be located at a particular height, and the shelf lengths are determined by the spacing between the posts to which the shelves are mounted. Also, there is no convenient way to create visual pause points along the shelves. As a result, it is difficult to support and display different sizes and types of items on a single gondola or to create varying, visually pleasing configurations which are adaptable for a variety of retail environments.

Similar shortcomings are found in prior art gravity feed dispensers. Typically gravity dispensers are standalone units that are not easily integrated with conventional gondolas and which have limited flexibility to incorporate other display and dispensing fixtures such as shelves, racks, hanger rods, storage bins, drawers, hooks, and the like. The inflexibility of prior art gravity feed dispensers often result in the loss of valuable shelf space in exchange for a more convenient form of dispensing. Thus, in situations where space is at a premium, there is a need for a gravity feed dispenser and a system for mounting the same that allows incorporation into a conventional gondola and use of additional fixtures, yet still allows easy access to the dispenser's top and bottom dispensing receptacle.

SUMMARY OF THE DISCLOSURE

The present inventors have now devised a unique solution to the problem of combining a gravity feed dispenser and conventional gondola. Accordingly, in one embodiment the present invention provides a display and dispensing system comprising a pair of spaced apart substantially vertical support members; a pair of L-shaped support members attached to the pair of vertical support members, each L-shaped support member having a first and a second end, a means for fastening the support member to the vertical support member disposed at the first end and a means for fastening a panel to the L-shaped support member disposed at the second end; a panel attached to the second end of the L-shaped support member; at least one substantially horizontal shelf; and a multi-chute gravity feed dispenser disposed above the at least one horizontal shelf.

In other embodiments the present invention provides a display and dispensing system comprising a pair of spaced apart substantially vertical support members; a pair of L-shaped support members attached to the pair of vertical support members, each support member having a first and a second end, a means for fastening the support member to the vertical support member disposed at the first end, and a hinge disposed at the second end; a panel attached to the hinge; at least one substantially horizontal shelf; a freestanding multi-chute gravity feed dispenser comprising a plurality of vertically aligned curvilinear chutes and a base disposed on at least one substantially horizontal shelf; and an individually packaged product selected from the group consisting of a roll of bath tissue, a carton of facial tissue and a roll of paper towels disposed in the multi-chute gravity feed dispenser and a bundle of multiple products selected from the group consisting of a roll of bath tissue, a carton of facial tissue and a roll of paper towels disposed on at least one substantially horizontal shelf.

In still other embodiments the present invention provides a display and dispensing system comprising a pair of spaced apart substantially vertical support members; a pair of L-shaped support members attached to the pair of vertical support members, each support member having a first and a second end, a means for fastening the support member to the vertical support member disposed at the first end, a hinge disposed at the second end and a rail support member; a panel attached to the hinge; at least one substantially horizontal shelf; a rail attached to the rail support members; a multi-chute gravity feed dispenser comprising a plurality of a vertically aligned chutes; and a bracket which attaches the multi-chute gravity feed dispenser to the rail.

In yet other embodiments the present invention provides a freestanding gravity feed dispenser comprising at least two vertically arranged curvilinear chutes each chute comprising a bottom panel, opposing first and second curvilinear side panels, a front stop panel, and a base.

In still other embodiments the present invention provides a gravity feed dispenser comprising a first curvilinear dispensing channel comprising a curvilinear shaped support member having a generally planar top surface, a back surface, a first end and a second end, a dividing member extending upward from and substantially perpendicular to the planar top surface and a stop panel disposed at the first end of the support member; a second curvilinear dispensing channel in a spaced apart relation from the first curvilinear dispensing channel, the second channel comprising a curvilinearly shaped support member having a generally planar top surface, a back surface, a first end and a second end, a dividing member extending upward from and substantially perpendicular to the planar top surface and a stop panel disposed at the first end of the support member.

DETAILED DESCRIPTION OF THE DISCLOSURE

Figure 1:
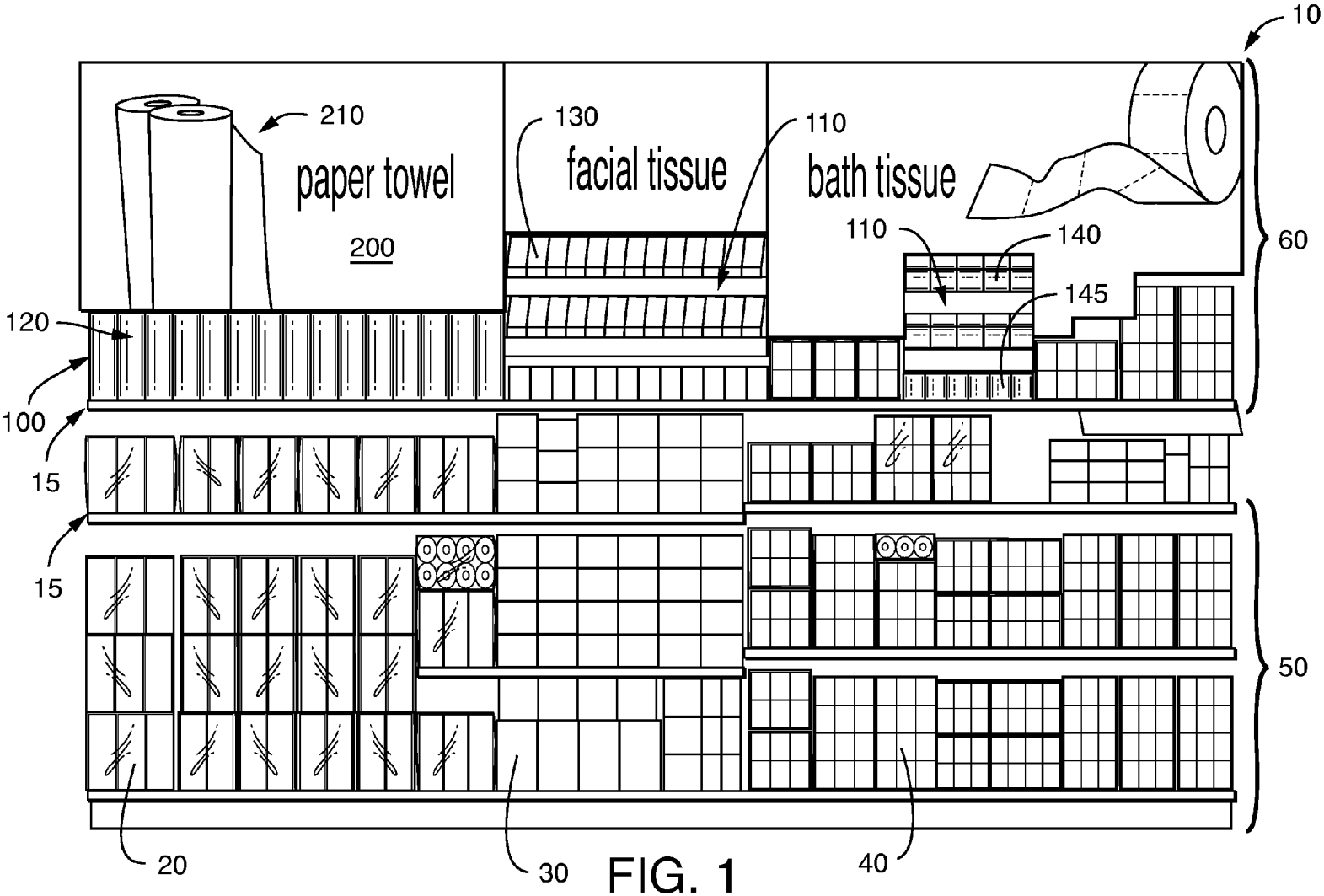
FIG. 1 illustrates a frontal view of a shelving display unit according to one embodiment of the present invention.

With reference to FIG. 1, a shelving display system 10 is illustrated. In the illustrated embodiment the shelving display system 10 includes substantially horizontal shelves 15, multi-chute gravity feed units 100, 110 and advertising panels 200. The horizontal shelves may be arranged in any number of configurations to display and dispense consumer goods. In a particularly preferred embodiment a horizontal shelf 15 defines the lower portion 50 of the shelving display system 10. Generally the horizontal shelves 15 are spaced and arranged so as to display and dispense products, such as bundled consumer goods, and more preferably bundles of paper towels 20, facial 30 and bath tissue 40. In certain embodiments, the multi-chute gravity feed unit may be free standing and supported by a horizontal shelf. For example, a horizontal shelf 15 supports a free-standing multi-chute gravity feed unit 110 having a plurality of chutes for displaying and dispensing individually packaged consumer products such as individual boxes of facial tissue 130, or individual rolls of bath tissue 140. The free-standing multi-chute gravity feed unit 110 may also include an alcove 145 for storing and dispensing individually packaged goods, such as individual rolls of bath tissue 140. In other embodiments the shelving display system 10 includes a free-standing multi-chute gravity feed unit 100 for dispensing individually packaged goods, such as rolls of paper towels 120.

Below the gravity feed units 100, 110 bundled packages of consumer goods such as paper towels 20, facial tissue 40 and bath tissue 50 are displayed and dispensed. In this manner the shelving display system 10 may be arranged so as to display and dispense both individually packaged consumer goods and bundled packages of consumer goods where the individually packaged goods are at least partially displayed and dispensed by multi-chute gravity feed units. In a particularly preferred embodiment the gravity feed dispensing units 100, 110 are disposed in the upper portion 60 of the shelving unit 10, above one or more horizontal shelves 15, such that individually packed goods are stored and dispensed above packages containing multiple goods bundled together.

As illustrated in FIG. 1, in a preferred embodiment, the individual packaged goods 120, 130 and 140 are displayed and dispensed from multi-chute gravity feed units 100, 110, which are positioned above bundled packaged of consumer goods 20, 30 and 40. In this manner a shopper may shop both individually packaged goods and bundled goods within a single column of the shelving display system. Further, the use of multi-chute gravity feed units 100, 110 above bundled packaged of consumer goods 20, 30 and 40 allows goods to be stored and dispensed from a greater height, compared to conventional shelving, increasing the amount of storage and display space per linear foot of shelving. Further, the present multi-chute gravity feed units 100, 110 may be stocked from the lower open portions which, avoids exposing store personal from being exposed to heights when restocking.

As further illustrated in FIG. 1, the upper most portion 60 is defined in-part by a panel 200 (also referred to as an access panel or door) that permits access to the multi-chute gravity feed units 100, 110 and may be used as a means of display advertising indicia 210. Advertising indicia may, for example, indicate the products or category of products stored in the associated multi-chute gravity feed dispenser display. The advertising indicia can be any of a number of signage such as an adhesive backed material, a plastic, paper or cardboard sheet.

Figure 2:
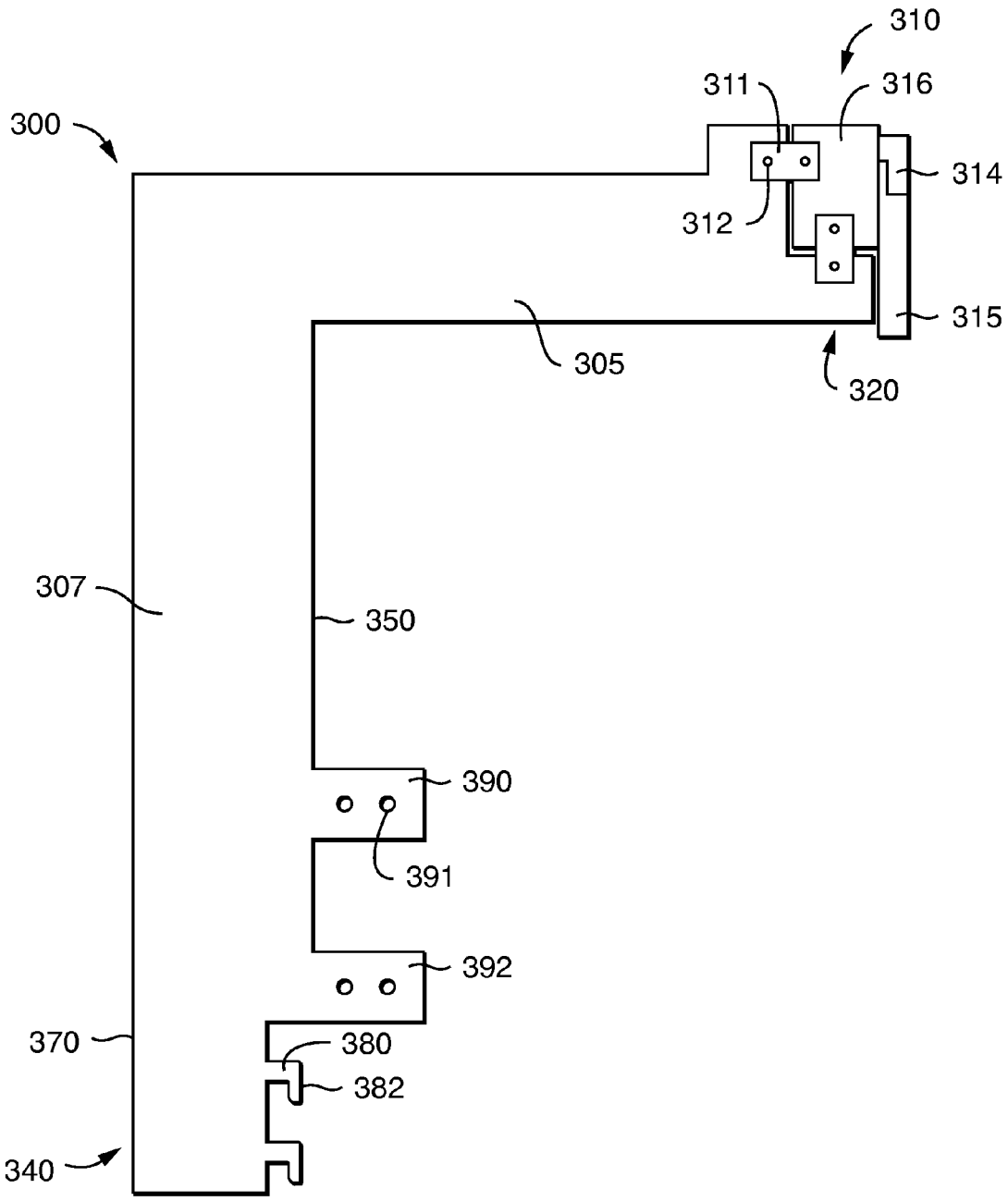
FIG. 2 illustrates a side view of an L-shaped support frame unit according to another embodiment of the present invention.
Figure 3:
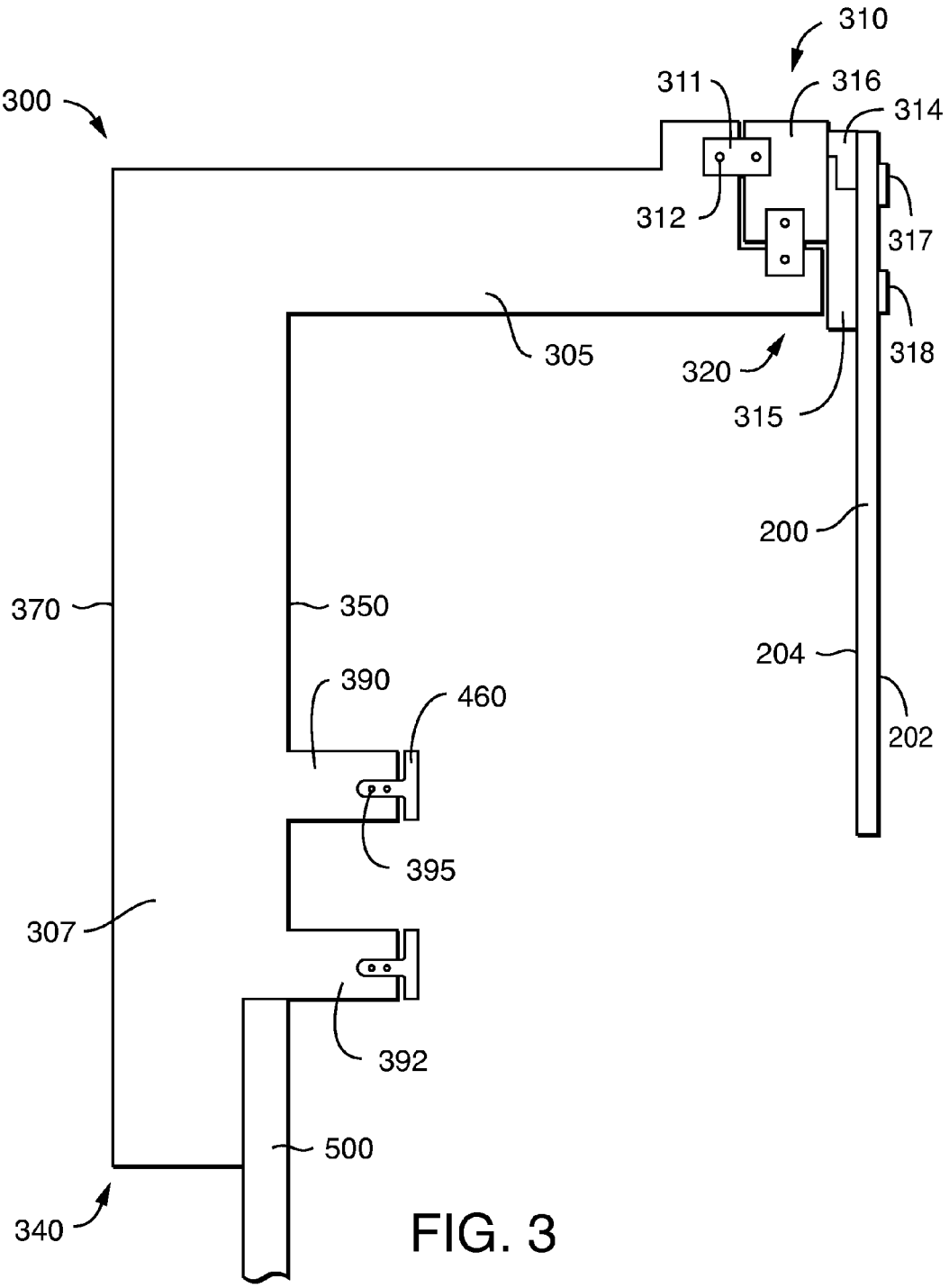
FIG. 3 illustrates a perspective view of an L-shaped support frame supporting a door according to one embodiment of the present invention.

In certain embodiments the door may be integrated with the shelving display unit using a support member which extends above and in front of the gondola. One example of one such support member is illustrated in FIGS. 2 and 3. With reference to FIG. 2 the support member 300 may be generally L-shaped support so as to extend above and beyond the gondola. In such configurations the frame 300 comprises a vertical arm 307 terminating in a first end 340 and a horizontal arm 305 terminating in a second end 320. The second end 320 is preferably adapted to receive and mount a panel 200. The panel 200 may be either moveably or fixedly attached to the second end 320 of the frame 300. In a particularly preferred embodiment the frame 300 is adapted to receive and mount a panel 200 in a moveable manner, such as by a hinge 310.

In one example, illustrated in detail in FIG. 3, the panel 200 is connected to an L-shaped support frame 300, which is in-turn attached to the gondola 500. In a particularly preferred embodiment the door 200 is connected to the frame 300 in a movable fashion by a hinge 310 disposed at the second end 320. The hinge 310 may be used to move the panel 200 from a closed position in which the support frame 300 is in a secured position against the panel 200 and an open position in which the panel 200 is moved away from the support frame 300 and allows access to a gravity feed dispenser.

Any suitable hinge known in the art may be used. In one embodiment the hinge may be configured to lock and retain the access door in a fully closed position until the door is deliberately opened manually. In a particularly preferred embodiment the hinge comprises a locking spring hinge in which the locking effect is attained efficiently and with adequate resilient bias force, but without affecting a closing force on the door until the access door is almost fully closed. Further, one skilled in the art will appreciate that there are several means of connecting the door, hinge and frame. In the illustrated embodiment the door 200 is connected to a support arm 315 by a pair of fasteners 317, 318. The support arm 315 is connected to a pivotal supporting means 314, which is in-turn connected to a counter-balance mechanism (included within the hinge body 316). When the door is opened a sufficient amount the counterbalance mechanism aids in lifting the door to its opened position.

The first end 340 of the frame 300 is adapted for mounting the frame 300 to the gondola 600. One skilled in the art will appreciate that there are several means of mounting a fixture, such as the L-shaped frame described above, to the gondola. In a particularly preferred embodiment the first end 340, having a front surface 350 and a back surface 370, has a pair of mounting brackets 380 having downwardly projecting prongs 382 disposed on the front surface. To mount the frame 300 to the gondola the pair of mounting brackets 380 are positioned behind the gondola and the prongs 382 are inserted into the apertures of the gondola posts at the desired height and then locked into place by forcing the frame 300 downward. In this manner, the frame 300 is mounted behind the gondola 600 and the horizontal arm 305 extends above and is cantilevered over the gondola 600, as illustrated in FIG. 3.

Figure 4:
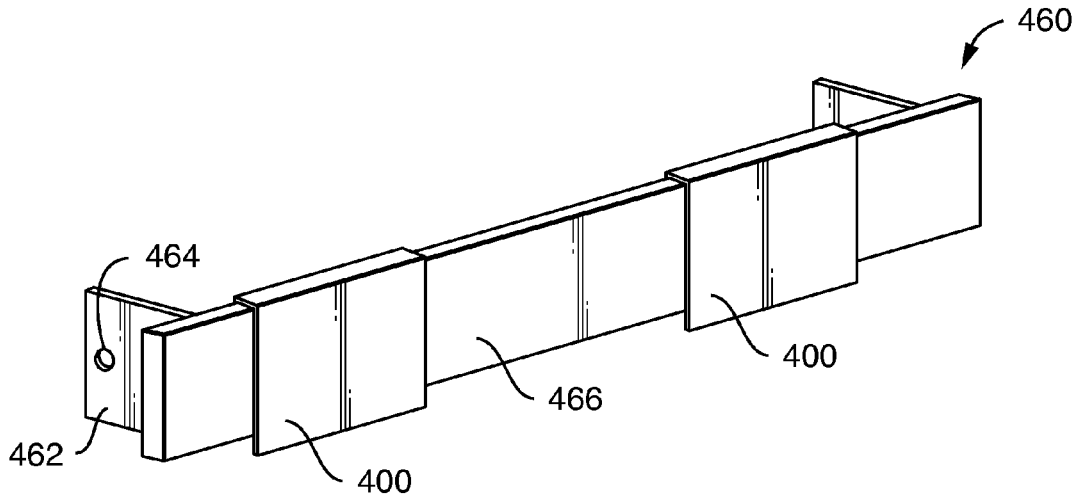
FIG. 4 illustrates a rail and brackets useful for attaching fixtures to the shelving display system.

In addition to including a means for mounting the support frame to the gondola, the support frame may also include one or more means to support additional fixtures in the shelving display system. For example, The L-shaped support frame 300 may include one or more supports 390, 392 for a rail. The rail supports 390, 392 extend from the front surface 350 of the frame 300. The rail supports 390, 392 are adapted to receive a rail 460 (illustrated in FIG. 4) that extends between two adjacent support frames 300. The rails 460 are preferably fixedly attached to the rail supports 390, 392. One skilled in the art will appreciate that the rails may be affixed to the rail supports using any one of a number of fasteners known in the art. For example, in one embodiment the rails 460 are attached to the rail supports 390, 392 by removable fasteners 395 such as a nut and bolt combination.

Figure 4A:
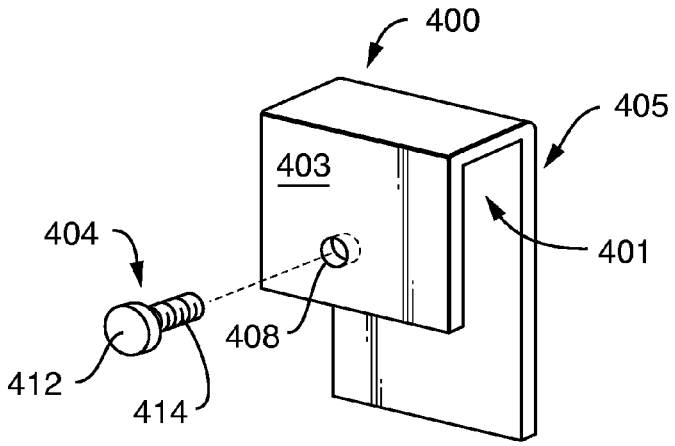

The rails 460 are generally shaped to receive mounting brackets 400 for mounting any one of a number of different fixtures, such as a multi-chute gravity feed dispenser, to the rails and in-turn the support frame. One illustrative mounting bracket 400 is shown in FIG. 4*a* and includes a saddle portion 401, preferably shaped to engage a rail 460, and optionally a locking member 404. The locking member 404, which may include a spring biased plunger, fits through an aperture 408 in the front wall 403 of the saddle portion. The plunger may be attached to a spring within the collar which biases the plunger into the rest or engagement position. The locking member 404 includes a head portion 412 and an engagement portion 414 which may be sized and positioned to engage and to rest against a rail 460. To adjust or move the mounting bracket 400 along the rail 460 the locking member 404 is disengaged and the bracket 400 is slid along the rail 460 to the desired position, whereupon the locking member 404 is reengaged and secures the bracket 400 in place.

With reference again to FIG. 1 the top portion 60 of the shelving display system 10 may include one or more access doors 200. As mentioned previously the panel 200 may be moveably attached to the shelving display system 10 by a hinge and a support frame (not illustrated in FIG. 1). In certain embodiments however, the door may be fixedly attached to the shelving display system via a support frame, in which case the door is referred to herein as a panel. Thus, the shelving and display system may comprise either a door or a panel, or both. For simplicity, however, the description will now generally refer only to an access door. The panel 200 includes a front surface 202 and a rear surface 204. The front face 202 is preferably substantially planar and provides a surface area for advertising display purposes, such as graphic indicia advertising the products therein. In a particularly preferred embodiment the front surface 202 of the panel 200 acts as a display panel for a multi-chute gravity feed dispenser.

In a particularly preferred embodiment, the front surface 202 may be used to display advertising indicia 210. In the illustrated embodiment, advertising indicia 210 is a roll of paper towels, which may correspond to the articles within the multi-chute gravity feed dispenser 100. One skilled in the art will appreciate that there are numerous means of affixing or displaying advertising indicia on the front surface of the access door, including printing or an adhesive label. Further the indicia may consist of information regarding the manufacturer and the product, logos, instructive material, and decorative and advertising indicia relative to the product in the shelving display system.

Turning now to the multi-chute gravity feed dispensers. Several distinct multi-chute gravity feed dispensers are contemplated for use in the shelving display system. The first multi-chute gravity feed dispenser 110, illustrated in FIG. 5, comprises one or more elongated chutes 510 defined by vertically arranged dividers 520, a back panel 525 and a bottom shelf 530. Each chute 510 has a top open end 515, a bottom dispensing end 517, and a rear face 519 extending between the top end 515 and the bottom dispensing end 517. The elongate chutes 510 are preferably provided in varying widths so that the dispenser can accommodate a variety of different sized items, such as a variety of different sized and shaped consumer products.

In a particularly preferred embodiment the chutes are arranged to display and dispense individually packed consumer goods, such as rolled paper towels 551, in a position such that the longitudinal axis 552 of the paper towels 551 extends vertically to the dividers 520. The paper towels are stacked one on top of the other and dispensed with the aid of gravity. In the illustrated embodiment, the hollow cores of one rolled paper products may be generally aligned with the hollow core of the adjacent rolled paper product and are not visible to a shopper. Rather, the shopper generally sees the advertising indicia printed on the paper towel packaging. In this arrangement, when the bottom most packaged good is removed by a shopper the packaged good immediate adjacent falls into the place of the removed good in response to a normal gravitational force.

Figure 5:
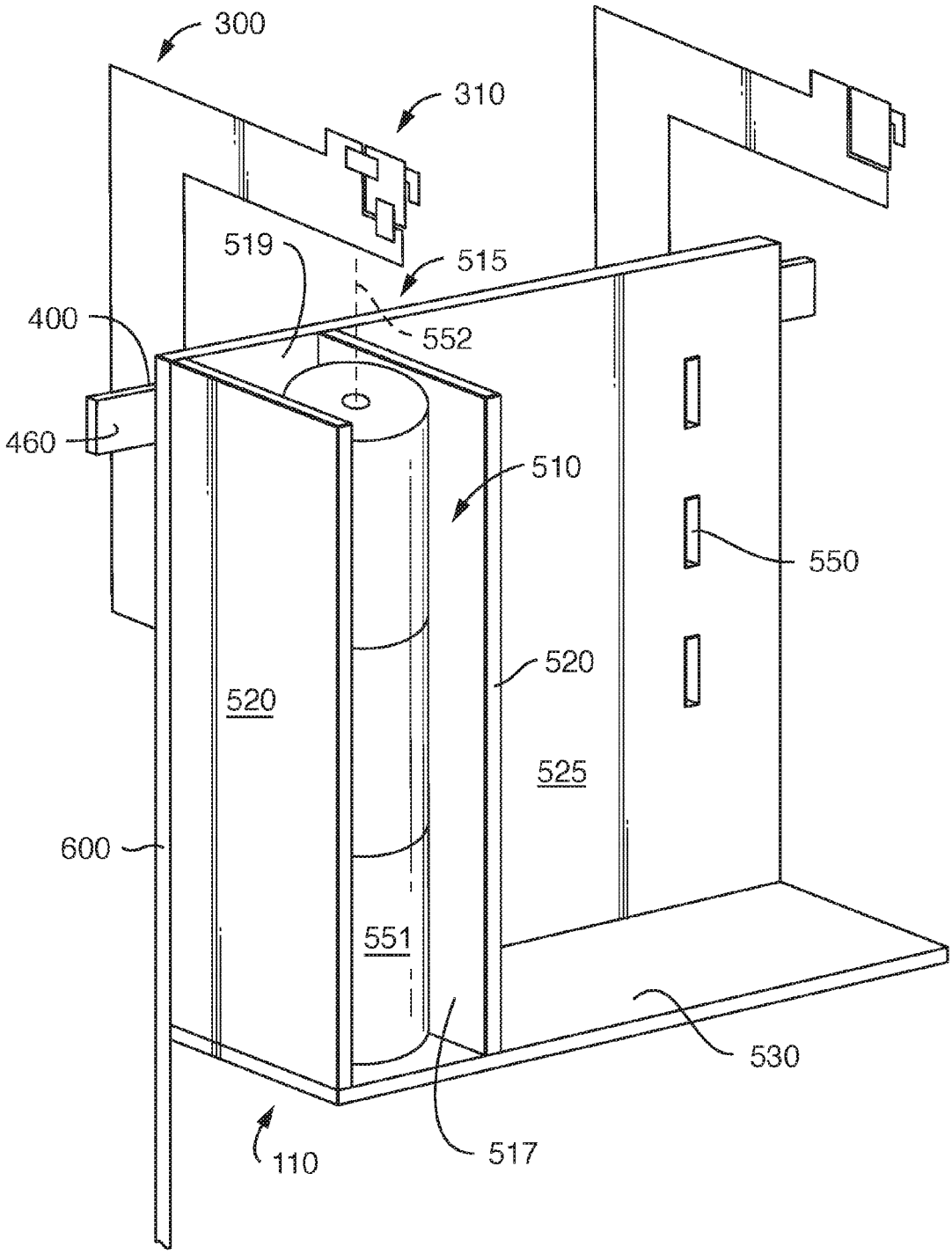
FIG. 5 illustrates a perspective view of a gravity feed dispenser according to one embodiment of the present invention.

The multi-chute gravity feed dispenser 110 is preferably made from a durable material, such as high impact styrene plastic or the like, but any suitable material can be used. In addition, although the preferred dispenser shown in FIG. 5 is of solid construction (i.e., is made up of a series of solid walls), the dispenser can also be of an open design. For example, in certain embodiments the back panel 525 and bottom shelf 530 may be constructed from a solid material, while the dividers 520 may have open portions, such as partial walls, pores or holes, which reduce the amount of material necessary to construct the panels, but still retain the article to be dispensed and do not interfere with dispensing. Further, the multi-chute gravity feed dispenser 110 is preferably configured to be used in connection with conventional store shelving in place at a retailer having a depth in the range of 18 to 24 inches. However, changes in scale or any dimension cited herein are within the scope of the present invention and may be adjusted based on any requirements for an application.

In one embodiment the multi-chute gravity feed dispenser 110 is assembled from discrete parts, which are interlocked together. For example, the back panel 525 may be provided with a plurality of slots 550 which are shaped to receive one or more teeth (not illustrated) disposed on the bottom shelf 530 and dividers 520. The multi-chute gravity feed dispenser 110 may in-turn be incorporated in the shelving display system of the present invention using a pair of L-shaped frames 300. The back panel 525 of the multi-chute gravity feed dispenser 110 is fitted with a bracket 400 which is then attached to a horizontal rail 460. The rail 460 is in-turn connected to the L-shaped frame 300, which is attached to the gondola 600. In this manner the multi-chute gravity feed dispenser 110 may extend above the top of the gondola, extending the amount of space for storing and dispensing product while also providing a space for displaying advertising, such as on a panel or door attached to the L-shaped frames 300.

Figure 6:
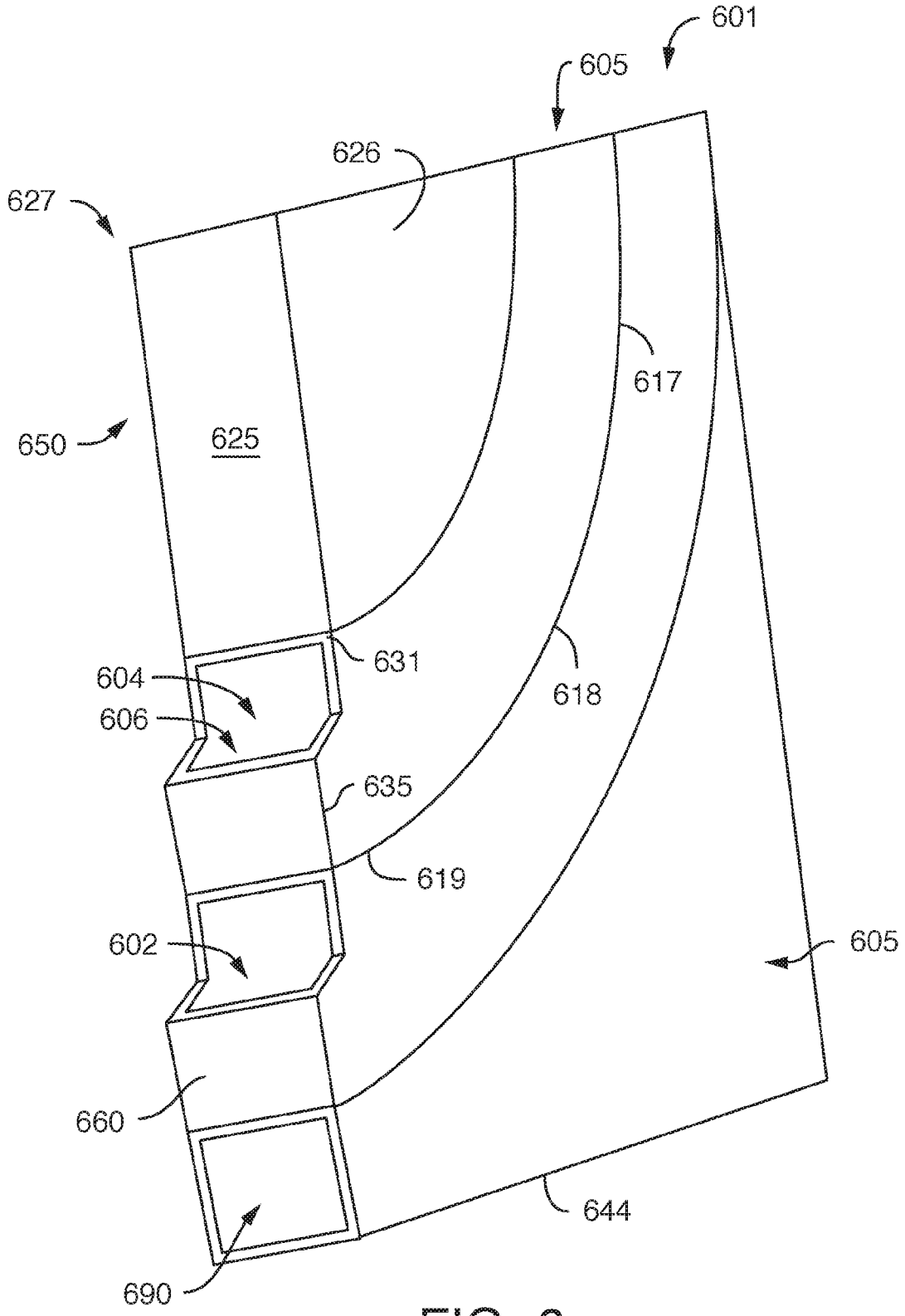
FIG. 6 illustrates a perspective view of a free-standing multi-chute gravity feed dispenser according to another embodiment of the present invention.
Figure 7A:
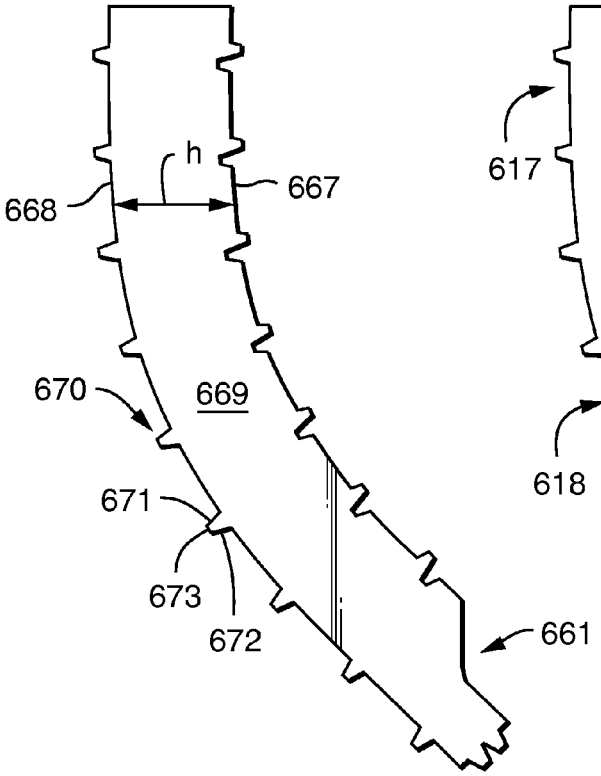
FIG. 7 illustrates panels useful in constructing a chute of a multi-chute gravity feed dispenser according to one embodiment to the present invention.
Figure 7B:
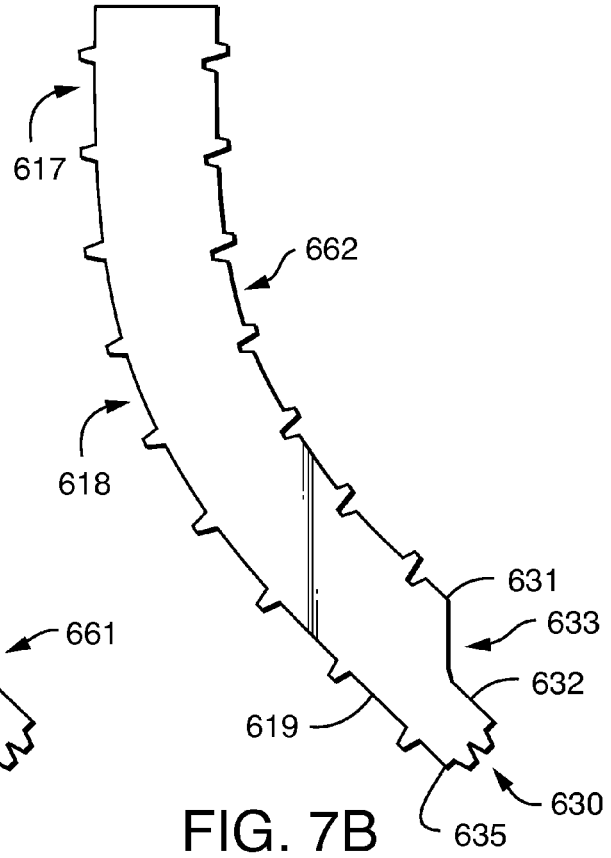
Figure 7C:
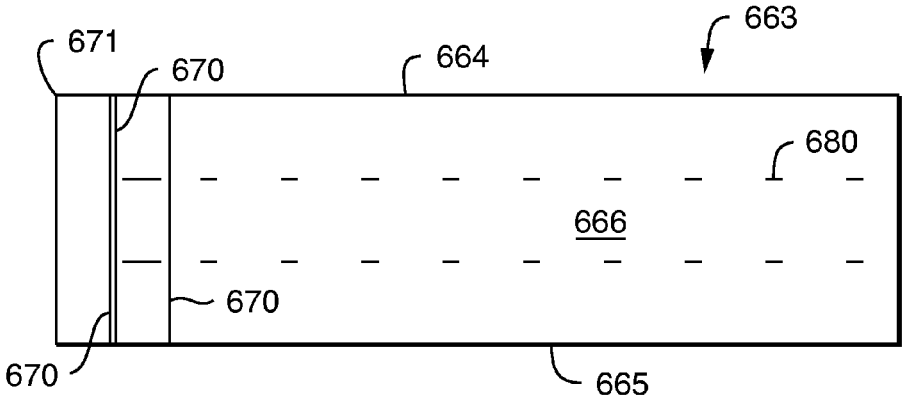
Figure 8:
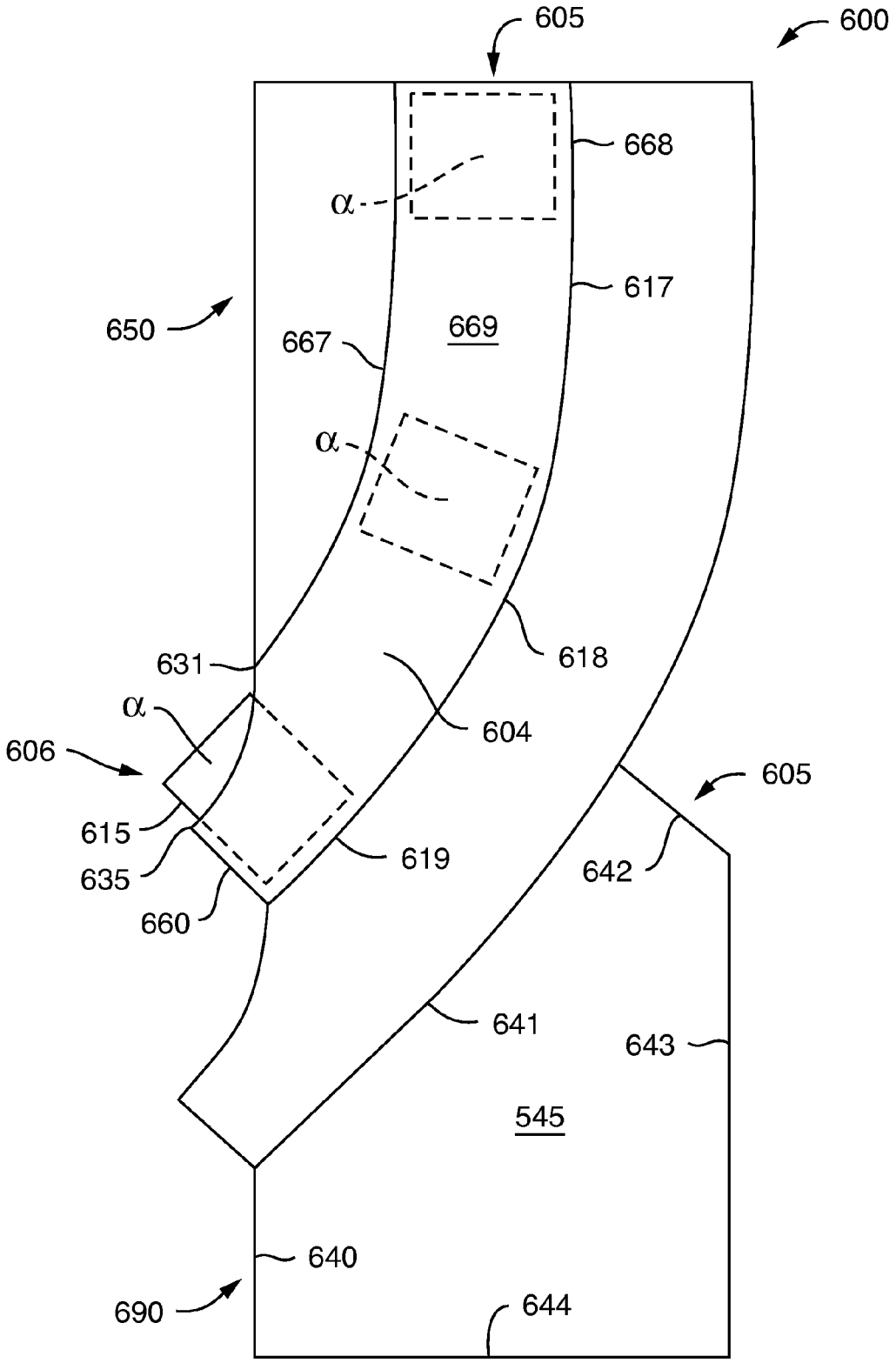
FIG. 8 illustrates a side view of a free-standing multi-chute gravity feed dispenser according to one embodiment of the present invention.

Turning now to FIGS. 6-8 another multi-chute gravity feed dispenser 601 useful in the present invention is illustrated. FIG. 6 shows a perspective view of a multi-chute gravity feed dispenser display 601 comprising a pair of vertically stacked chutes 602, 604. The chutes are formed from a bottom panel and a pair of opposing side panels (illustrated in detail in FIGS. 7A-C). The multi-chute gravity feed dispenser 601 illustrated in FIG. 6 is free-standing and is supported by a base 605 that allows the dispenser 601 to be set on a store shelf without any additional support or fixtures. The illustrated multi-chute gravity feed dispenser 600 also includes a display panel 650 which may be used to display advertising indicia. The multi-chute gravity feed dispenser 601 is preferably configured to be used in connection with conventional store shelving in place at a retailer having a depth in the range of 18 to 24 inches. However, changes in scale or any dimension cited herein are within the scope of the present invention and may be adjusted based on any requirements for an application.

In certain embodiments a gravity feed dispenser 601 may be formed from interlocking panels 661, 662 and 663 illustrated in FIGS. 7A-C. For example, in one embodiment the dispenser may comprise a pair of side panels 661, 662 and a bottom panel 663. The bottom panel 663 generally has a rectilinear shape with a pair of side edges 664, 665 and a central portion 666 extending there-between. The side panels generally comprise a top edge 667 a bottom edge 668, and a central portion 669 extending there-between. The distance between the top edge 667 and bottom edge 668 of the side panel define the height (h) of the panel which is generally continuous along the length of the panel.

The terminal end 630 of the side panel 662 may be shaped to form a recess 633 to better display and dispense product. The recess 633 may take on several different shapes. One exemplary shape is illustrated in FIG. 7B in which the recess 633 is formed by a first edge 633 that slopes downward from a first terminal edge 631 and then extends horizontally to a second terminal edge 635.

In certain embodiments the panels may be interconnected with one another using a system of interlocking teeth 670 and tooth slots 680. For example, with further reference to FIGS. 7A-C, each side panel 661, 662 may include a plurality of teeth 670 spaced along the upper 667 and lower edges 668 of the panel which project outward from the edge of the panel and engage an interlocking tooth slot 680 disposed on the bottom panel 663. Each tooth 670 has a pair of lateral side walls 671, 672 and a horizontally extending front tooth edge 673. The tooth slots 680 correspond to, and interact with, the laterally spaced teeth 670 to interlock the panels with one another to form a chute. In this manner two side panels may be interlocked with a bottom panel to form a chute. Further, a second chute may be interconnected with the first by attaching a second bottom panel to the side panels by interconnecting the teeth extending upward from the top edge of the panels with the tooth slots on the second bottom panel. In this manner a modular system is provided in which additional vertical chutes may be easily created. In other embodiments a display panel or a support base may be interconnected with the bottom and side panels using similar interconnecting teeth and tooth slots.

With reference again to FIG. 6, the panels may be connected to define chutes 602, 604 having an open upper end 605 and an open bottom end 606 through which product may be both loaded and withdrawn from the chute 604. Generally the open upper end 605 and an open bottom end 606 are out of plane with one another—the open upper end 605 lying in a generally vertical plane and the open bottom end 606 lying in a slightly inclined horizontal plane. Thus chute 604 is generally shaped such that it curves from one orientation at its open upper end 605 to another orientation at its bottom end 606. While the chutes have a generally curvilinear shape, the size of the panels may vary to accommodate products of differing size. Further, one skilled in the art will appreciate that the size and spacing of the tooth slots may be varied to correspond to the side edge teeth and to achieve the desired chute rigidity and stability.

As illustrated in FIGS. 6, 7 and 8, the side panels 661, 662 generally have a curvilinear shape. The exact shape of the side panels may be varied to provide for optimum dispensing. However, in one embodiment the side panel 661 has a generally linear first end portion, a curving middle portion and a linear second end portion. When the side panels are assembled to form a chute 604, the chute 604 has an upper portion 617 which is inclined to the vertical such that product is capable of continuous movement along the chute response to a normal gravitational force. The middle portion 618 of the chute 604 has a continuous curvature and the bottom portion 619 is inclined to the horizontal such that product comes to a rest at the bottom open end 606 of the chute 604. To further stop the product in the chute 604, product travel stop 660 may be formed at a lowest extent of the chute. In a particularly preferred embodiment the travel stop 660 is continuous with the bottom panel 663 and is formed by folding the bottom panel 663 along a series of score marks 670 disposed near the front edge 671 of the panel 663. In other embodiments the stop may be formed from one or more additional panels affixed to the one or more panels forming the chute. Regardless of how it is formed, the stop 660 engages the product to prevent unwanted further movement down chute 604 and positions the product for viewing and selection by a customer.

Where multiple chutes are provided the chutes are generally a curvilinear shape, however, the chutes may be of differing lengths. For example, as illustrated in FIG. 6, the upper chute 604 is shorter than bottom chute 602. As a result, more product may be disposed in the bottom chute 602 than in the top chute 604. Having chutes of differing lengths allows the chutes to be stacked vertically and to complement one another without wasting space.

The panels are preferably made from a durable material, such as high impact styrene plastic, or the like. However, it will be recognized by those of skill in the art that any other suitable material of construction may be used that also provides a sufficiently low enough coefficient of friction to facilitate the movement of products within the multi-chute gravity feed dispenser display. Further, the dispenser may be expanded to include as many additional panels as desired. For example, although the dispenser illustrated in FIGS. 6 and 8 comprises two chutes formed from two pairs of spaced apart and interlocked panels, the dispenser may comprise one, two, three or more chutes. In addition, although the embodiment shown in such figures utilizes side panels having a particular height, other embodiments use panels having different heights for the purpose of accommodating products that have a different height than the product illustrated. Further, the various panels may be held together by means other than the interlocking teeth described herein, such as by mechanic or adhesive means. In still other embodiments the chutes may be formed as a unitary member comprising a base panel and a pair of spaced apart side panels. Further, while the product in FIG. 8 is illustrated as being cubical, products having different forms may be displayed and dispensed. For example, the gravity feed dispenser may also be used to display and dispense products having a cylindrical form, like bath tissue or rolled paper towels. Yet additional embodiments use products of a variety of other shapes or packaging designs, otherwise capable of being received by chutes. Further, the product loaded into the different chutes may be different from one-another.

FIG. 8 shows a side view of a multi-chute gravity feed dispenser 600, in accordance with the embodiment described in detail above. Product, illustrated as a carton of facial tissue, is generally displayed and dispensed at the open bottom end 606. To restock the dispenser 600 product is loaded into the open bottom end 606 and subsequent product is added pushing product upwards towards the upper open end 605. While the upper end 605 is also open and can receive product, in use it may be elevated beyond the reach of a user making restocking of product from the top difficult. Thus, one advantage of the present invention is that additional new product may be added to the multi-chute gravity feed dispenser from the front without having to alter or arrange the dispenser and generally without exposing the individual restocking to any heights.

In those instances where product is loaded into the chute through the open lower end, product is generally forced up the chute by the user from a first position. Subsequent product is then loaded into the chute through the open bottom end pushing the previously loaded product towards the upper end of the chute. When the chute is filled with product the final position will generally be proximal to the top open end of the chute and the first position is generally adjacent to the stop. For example, with reference to FIG. 8, when the chute 604 is filled with product the upper-most product will generally have an axis a that is substantially perpendicular to the top 667 and bottom 668 edges of the side panel 669 at its upper most end 617. In this manner, the side panels, and consequently the resulting chute, are shaped such that the angle of the products axis a rotates from a vertical orientation to nearly horizontal as the product travels in the chute 604 from the open bottom end 606 to the open upper end 605.

Once loaded, product rests on the stop 660 and is displayed at the open first end 606 and ready to be dispensed to a shopper. In this manner the open first end 606 may also be referred to as dispensing ends, dispensing bays, or product removal areas. The shopper then withdraws the product from the open first end 606 and the remaining product slides down the chute to fill the open space, again placing product in the open first end where it is displayed and ready to be dispensed to a shopper.

As illustrated in FIG. 6, in one embodiment, the multi-chute gravity feed dispenser 600 is supported by a base 605 having an opening 690. The opening 690 provides an additional space to display and dispense product and may also provide a shopper a place to dispose of product which was not purchased. The next purchaser interested in the product may then either withdraw product from the gravity feed dispenser or shop product from the open space.

The multi-chute gravity feed dispensers may be integrated with the shelving display system a number of different ways. In one embodiment, such as that illustrated in FIGS. 6 and 8, the multi-chute gravity feed dispenser 600 is free-standing, that is, it is not affixed to the shelving display system by the use of hardware. The free standing multi-chute gravity feed dispensers 600 may be formed by providing a support base 605 upon which the chutes may rest. The support base 605 may in-turn be placed on one of the shelves of the shelving display unit. In one embodiment the support base is formed from three panels—a pair of side panels and a back panel. In certain embodiments, such as that illustrated in FIG. 8, the side panels 545 may be a five-sided polygon having a bottom edge 644, a chute contacting edge 641 and a back edge 643. The chute contacting edge 641 and the back edge 643 may have one or more teeth protruding therefrom interlocking the sides with the chute and back piece respectively. Where the side panels possess teeth for interlocking, as described above in regards to formation of the chutes, the structure receiving the sides has one or more tooth slots for receiving the teeth.

The bottom edge 644 of the base 605 is generally planar and contacts a shelf 15 when the free standing dispenser is integrated with the shelving display system 10. Further, in certain preferred embodiments the base 605 is provided with an alcove 690. In such embodiments the alcove 690 forms an additional space for displaying and dispensing product.

In certain embodiments, such as that illustrated in FIGS. 6 and 8, the multi-chute gravity feed dispenser may include a facing module 650. The facing module 650 generally comprising a plurality of panels, such as a front panel 625, a first side panel 626 and a second side panel 627. The side panels 626, 627 may be formed from a continuous piece of material or may include cut-outs, holes or spaces. Further, the facing module 650 may be formed from a single unitary piece or may be constructed from multiple pieces. The facing module 650 may be fixedly or removably attached to the chute of a multi-chute gravity feed dispenser 600. In certain embodiments the facing module may include tooth slots (not illustrated), which may be shaped to receive teeth protruding from the upper edge of the adjoined gravity feed side panel. In this manner the facing module and the gravity feed chute may be interlocked with one another as described previously.

The facing module 650 may be disposed above the upper most gravity feed dispenser 600 in a linear manner such that the front panel 625 of the facing module 650 is aligned with the first terminal edge 631 of the gravity feed dispenser 600. In certain embodiments the stop 660 may extend beyond the front panel 625, such that the chute has a cavity that extends beyond the front panel 625 and allows product to be displayed and dispensed beyond the vertical plane of the front panel 625. In certain embodiments the front panel 625 may include advertising indicia, which may, for example, indicate the products or category of products stored in the associated multi-chute gravity feed dispenser display. The signage can be any of a number of advertising indicia such as an adhesive backed material, a plastic, paper or cardboard sheet.

Facing modules are particularly useful in connection with free-standing multi-chute gravity feed dispensers and may, in certain embodiments, replace the need for additional signage. For example, in certain embodiments, the shelving display system may comprise a free-standing multi-chute gravity feed dispenser comprising a facing module, where the facing module comprises at least one advertising indicia indicating the contents of the dispenser and where the dispenser is not covered by a door or a panel. In such embodiments the need for a support frame and door or panel is eliminated, yet the advantages of additional storage and dispensing space are gained along with additional advertising indicia.

Figure 9:
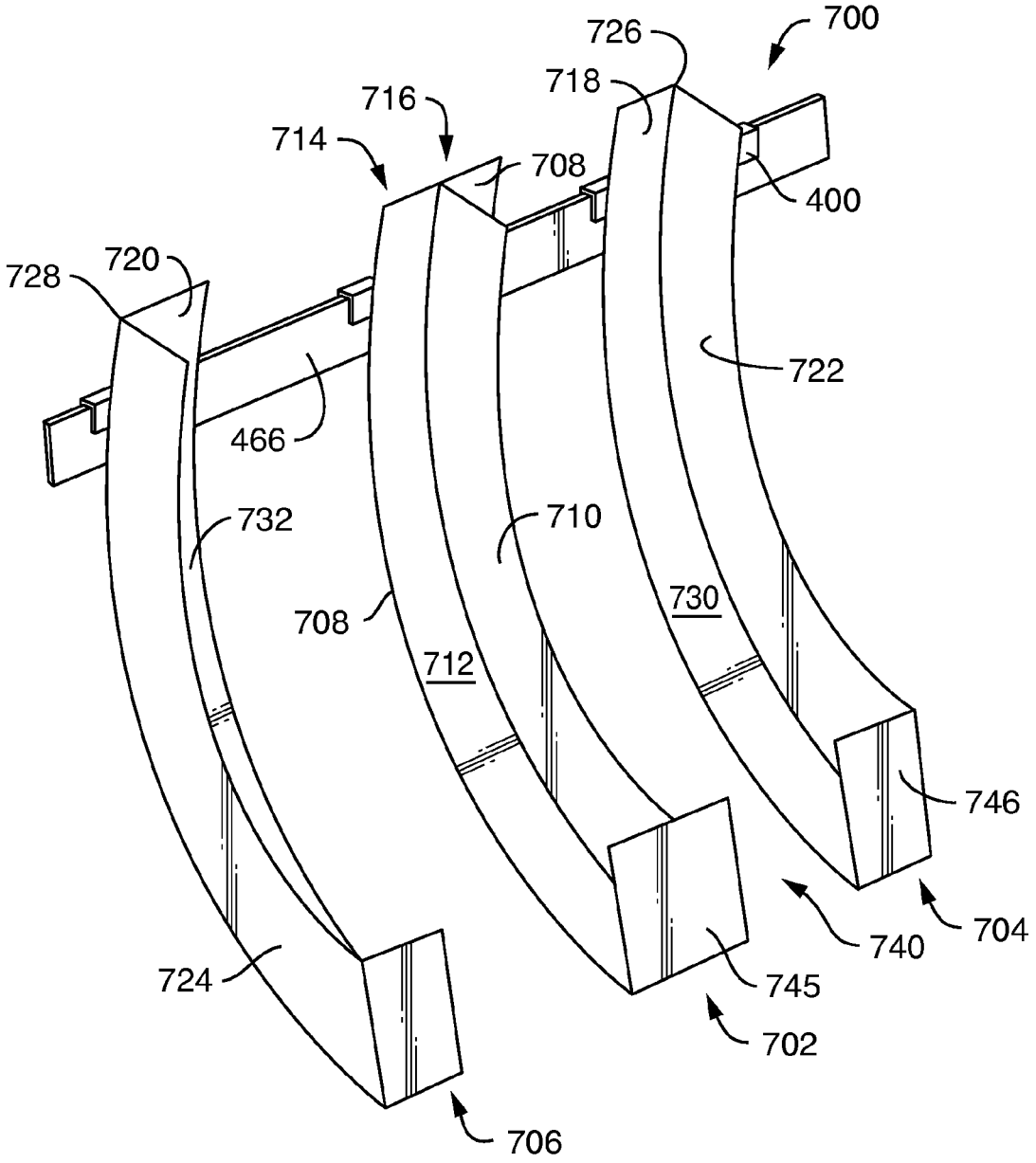
FIG. 9 illustrates perspective view of a modular multi-chute gravity feed unit according to another embodiment of the present invention.
Figure 10:
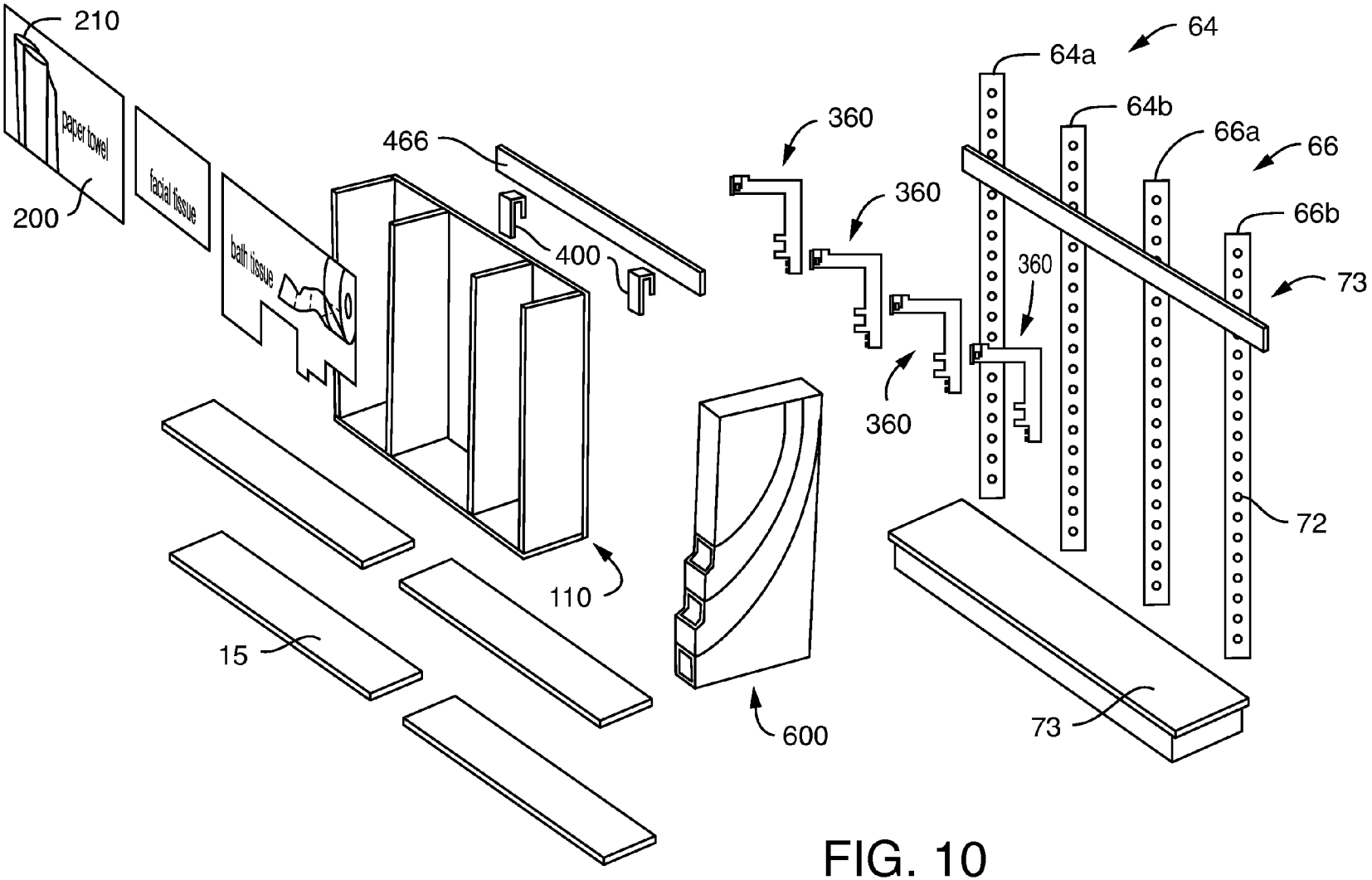
FIG. 10 illustrates an exploded view of a shelving display system according to one embodiment of the present invention.

In still other embodiments the present invention provides a gravity fed dispenser, such as that illustrated in FIGS. 9 and 10, which lacks a back member and is generally formed from spaced apart dispensing channels. With reference to FIG. 9, the gravity feed dispenser 700 may comprise a combination of one or more T-shaped 702 and L-shaped 704, 706 dispensing channels. The T-shaped dispensing channel 702 is formed from a curvilinear support member 708 divided by a dividing member 710. The dividing member 710 extends from the generally planar top surface 712 of the curvilinear support member 708 and is generally perpendicular thereto. In this manner the support member 708 is divided into a left-hand support member 714 and a right-hand support member 716. The dispensing channel 702 may further comprise a stop 745 disposed at the bottom end to retain product to be dispensed and displayed.

L-shaped dispensing channels 704, 706 may be formed in a similar manner from a curvilinear support member 718, 720 and a lateral member 722, 724 extending from one edge 726, 728 and generally planar to the top surface 730, 732 of the curvilinear support member. In this manner a left handed 706 and right handed 704 L-shaped dispensing channel may be formed.

One skilled in the art will appreciate that various gravity fed dispensers may be formed by combining two or more T-shaped dispensing channels with one another, combining T-shaped and L-shaped dispensing channels or combing two L-shaped dispensing channels. For example, as illustrated in FIG. 9, a right hand L-shaped dispensing channel 704 and a T-shaped dispensing channel 702 may be attached to a rail 460 by a bracket 400 and arranged in a spaced apart relation. The chute width may be adjusted by moving the brackets along the rail to adjust the relative position of the dispensing channels. Preferably the chute width is adjusted to accommodate and support the product to be displayed and dispensed. Additional channel members may be added in a horizontal arrangement by attaching the members to the rail thereby creating additional dispensing channels there between.

Turning again to the shelving display system generally, as shown in FIG. 1, in one embodiment the system comprises a support structure 120 to which one or more fixtures, such as support frames 300 (not illustrated in FIG. 1) and shelves 15, are mounted. As is well known in the art, support structures may be designed and configured so that a variety of different fixtures, such as shelves, racks, hanger rods, storage bins, drawers, hooks and the like, can be mounted on the support structure.

In one embodiment the support structure comprises a plurality of vertical standards or posts mounted to a base. Vertical posts are aligned on the base so that the front surface of each vertical post lies in the same front plane. Each vertical post has a front surface featuring a series of vertical slots. As described in more detail below, slots are sized and shaped to receive mounting brackets, thereby allowing a variety of different fixtures to be mounted to the vertical posts. In a preferred embodiment, the support structure is approximately 84 inches in height, and the base 20 is about 40 inches long, 24 inches deep and 6 inches in height. Preferably, the base is a modular unit so that it can be combined with other like bases to create a row or aisle of display or shelving units.

Support structures described above (exclusive of the various fixtures attached thereto) are well known in the art and need not be described in further detail here. Further, such support structures are commercially available from a number of different sources. It should be understood that the support structure is described for illustrative purposes only, and is not meant to limit the scope of the present invention. Any type of suitable support structure can be used in the present invention.

FIG. 10 is an exploded view of one embodiment of a shelving display system according to the present invention. Beginning at the right hand edge of the view, two conventional gondola units, 64 and 66, are illustrated, each having a pair of upstanding base posts (64*a*, 64*b* and 66*a*, 66*b* respectively) secured to rear corners of each base, along the rear vertical surface of the base. These upstanding posts include a series of apertures 72 running their entire length. Additionally, optional horizontal stabilizer rails 73 are attached to each pair of posts to help stabilize the posts of the gondola units.

Continuing left in FIG. 10, two pairs of L-shaped mounting frames 360 in accordance with the invention are shown. These frames, which are illustrated in greater detail in FIGS. 2 and 3, are mounted in the desired apertures 72 of gondola posts 64*a*, 64*b* and 66*a* and 66*b*. The mounting frames are mounted to the gondola posts such that they are cantilevered out over the gondola with the second end 320 extending beyond the gondola. As described previously the mounting frame 300 may include mounting brackets 380 that engage with mounting post apertures 72. Although apertures 72 are illustrated as round through-holes, they may be blind holes and of any shape or depth which will receive and hold fixture in locking engagement. Alternatively, the tracks need not be provided with apertures in which case the shelf/display members will be fastened by alternate means such as clamping devices.

Continuing left in FIG. 10 a rail 466 is connected to one of the L-shaped frames 300 and used to support a gravity feed unit 110. The rails are orientated perpendicular to the gondola posts and generally span between two adjacent L-shaped frames. Each rail 460 is fitted with a pair of brackets 400. The brackets 400 in-turn facilitate the attachment the gravity fed dispenser 110 to the rail 460.

Two different types of gravity fed dispensers are illustrated in FIG. 10. The left most dispenser 110 is attached to the shelving display system by brackets 400. The first gravity feed dispenser 110 comprises a plurality of substantially vertically orientated elongated chutes defined by vertically arranged dividers, a back panel, a bottom shelf and a pair of brackets 400 which attaches the multi-chute gravity feed dispenser 110 to the rail 466. The second gravity feed 600 dispenser comprises a plurality of vertically aligned curvilinear chutes and a base. The second gravity feed dispenser 600 is free-standing and is mounted on a shelf 15. The gravity feed dispensers are generally adapted to display and dispense individually packaged consumer goods, such as individual rolls of bath tissue, individual rolls of paper towels or individual cartons of facial tissue.

The shelving display system further comprises a series of shelves 15 mountable to the gondola posts 64*a*, 64*b* and 66*a* and 66*b*, such as by brackets or the like. For example, brackets can be integrally formed as part of the shelves or attached to the shelves using any suitable means, such as spot welding or bolting and disposed along the rear edge of the shelf. The brackets may be a size and shape which will engage mounting post apertures 72. Thus, shelves may be attached to mounting posts at the desired heights. Further, it is desired that the shelves 15 be spaced and arranged so as to display and dispense bundles of consumer goods, and more preferably bundles of paper towels 20, facial 30 and bath tissue 40. The shelves 15 may also serve to support free-standing gravity fed dispensers.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Many modifications and variations of the present disclosure can be made without departing from the spirit and scope thereof. Therefore, the exemplary embodiments described above should not be used to limit the scope of the invention.

What is claimed is:

1. A display and dispensing system comprising:

a. a pair of spaced apart substantially vertical support members;

b. a pair of L-shaped support members attached to the pair of vertical support members, each L-shaped support member having a first and a second end, a rail support member, a means for fastening the support member to the vertical support member disposed at the first end and a means for fastening a panel to the L-shaped support member disposed at the second end;

c. a rail attached to each of the rail support members;

d. a panel attached to the second end of each of the L-shaped support members;

e. at least one substantially horizontal shelf; and f. a multi-chute gravity feed dispenser disposed above the at least one horizontal shelf.

2. The display and dispensing system of claim 1 wherein the means for fastening the panel to the first end of the L-shaped support member comprises a hinge.

3. The display and dispensing system of claim 1 wherein the panel covers at least a portion of the multi-chute gravity feed dispenser.

4. The display and dispensing system of claim 1 wherein the panel further comprises at least one advertising indicia.

5. The display and dispensing system of claim 1 further comprising an individually packaged product selected from the group consisting of a roll of bath tissue, a carton of facial tissue and a roll of paper towels disposed in the multi-chute gravity feed dispenser and a bundle of multiple products selected from the group consisting of a roll of bath tissue, a carton of facial tissue and a roll of paper towels disposed on at least one substantially horizontal shelf.

6. The display and dispensing system of claim 1 wherein the multi-chute gravity feed dispenser is a free-standing gravity feed dispenser comprising a plurality of vertically aligned curvilinear chutes and a base, the freestanding gravity feed dispenser disposed on at least one substantially horizontal shelf.

7. The display and dispensing system of claim 1 wherein the multi-chute gravity feed dispenser comprises a plurality of substantially vertically orientated elongated chutes defined by vertically arranged dividers, a back panel, a bottom shelf and a bracket which attaches the multi-chute gravity feed dispenser to the rail.

8. The display and dispensing system of claim 1 further comprising a first curvilinear dispensing channel comprising a curvilinear support member having a generally planar top surface, a back surface, a first end and a second end, a dividing member extending upward from and substantially perpendicular to the planar top surface, a stop panel disposed at the first end of the support member and a bracket disposed on the support member for attaching the channel to the rail; a second curvilinear dispensing channel comprising a curvilinear support member having a generally planar top surface, a back surface, a first end and a second end, a dividing member extending upward from and substantially perpendicular to the planar top surface, a stop panel disposed at the first end of the support member and a bracket disposed on the support member for attaching the channel to the rail; and a product to be dispensed disposed between and supported by the first and second curvilinear dispensing channels.

9. A display and dispensing system comprising:

a. a pair of spaced apart substantially vertical support members;

b. a pair of L-shaped support members attached to the pair of vertical support members, each support member having a first and a second end, a rail support member, a means for fastening the support member to the vertical support member disposed at the first end, and a hinge disposed at the second end;

c. a panel attached to the hinge;

d. a rail attached to each of the rail support members;

e. at least one substantially horizontal shelf;

f. a freestanding multi-chute gravity feed dispenser comprising a plurality of vertically aligned curvilinear chutes and a base disposed on at least one substantially horizontal shelf; and g. an individually packaged product selected from the group consisting of a roll of bath tissue, a carton of facial tissue and a roll of paper towels disposed in the multi-chute gravity feed dispenser and a bundle of multiple products selected from the group consisting of a roll of bath tissue, a carton of facial tissue and a roll of paper towels disposed on at least one substantially horizontal shelf.

10. The display and dispensing system of claim 9 further comprising:

a. a second pair of L-shaped support members attached to the pair of vertical support members, each support member having a first and a second end, a means for fastening the support member to the vertical support member disposed at the first end of each L-shaped support member, a hinge disposed at the second end of each L-shaped support member and a rail support member;

b. a second panel attached to the hinge disposed at the second end of each L-shaped support member; and c. a multi-chute gravity feed dispenser comprising a plurality of substantially vertically orientated elongated chutes defined by vertically arranged dividers, a back panel, a bottom shelf and a bracket which attaches the multi-chute gravity feed dispenser to the rail.

11. The display and dispensing system of claim 10 wherein the panel covers at least a portion of the freestanding multi-chute gravity feed dispenser and the multi-chute gravity feed dispensers.

12. The display and dispensing system of claim 9 further comprising a gravity feed dispensing unit comprising:

a. a first curvilinear dispensing channel comprising a curvilinearly shaped support member having a generally planar top surface, a back surface, a first end and a second end, a dividing member extending upward from and substantially perpendicular to the planar top surface and a stop panel disposed at the first end of the support member;

b. a second curvilinear dispensing channel in a spaced apart relation from the first curvilinear dispensing channel, the second channel comprising a curvilinearly shaped support member having a generally planar top surface, a back surface, a first end and a second end, a dividing member extending upward from and substantially perpendicular to the planar top surface and a stop panel disposed at the first end of the support member; and c. a product to be dispensed disposed between and supported by the first and second curvilinear dispensing channels.

* * * * *